United States Patent [19]

Mita

[11] 4,127,922

[45] Dec. 5, 1978

[54] LATCH DEVICE FOR A SAFETY BELT BUCKLE IN A VEHICLE AND METHOD OF ASSEMBLING THE SAME

[75] Inventor: Akira Mita, Fujisawa, Japan

[73] Assignee: NSK-Warner, K.K., Tokyo, Japan

[21] Appl. No.: 755,651

[22] Filed: Dec. 30, 1976

[30] Foreign Application Priority Data

Feb. 18, 1976 [JP] Japan ..... 51-16837
Oct. 19, 1976 [JP] Japan ..... 51-139657[U]

[51] Int. Cl.[2] ..... A44B 11/25
[52] U.S. Cl. ..... 24/230 A
[58] Field of Search ..... 24/230 A, 230 AK, 230 AL, 24/230 AV, 230 AM, 230 AN

[56] References Cited

U.S. PATENT DOCUMENTS 3,285,700 11/1966 Prisbe ..... 24/230 A
3,494,007 2/1970 Dahms ..... 24/230 A
3,588,969 6/1971 Fisher ..... 24/230 A
3,932,917 1/1976 Dobelmann ..... 24/230 A

*Primary Examiner*—Kenneth J. Dorner
*Attorney, Agent, or Firm*—Shapiro and Shapiro

[57] ABSTRACT

A latch device for a safety belt buckle comprises a base, a latch member pivotally supported on the base and having a latching portion for locking a tongue, the latch member being biased to a tongue-locking position, a push button adapted, when operated, to bring the latch member to an unlocking position, and a cover having an inlet for inserting a tongue therethrough and an opening through which the push button may be operated. The latch member is pivotally supported in mutually opposed holes formed in the opposite side walls of the base. At least one of the opposite side walls of the base is formed with a longer hole continuous to the upper portion of the hole so that the longer hole may be used to assemble the latch member to the holes.

8 Claims, 10 Drawing Figures

LATCH DEVICE FOR A SAFETY BELT BUCKLE IN A VEHICLE AND METHOD OF ASSEMBLING THE SAME

BACKGROUND OF THE INVENTION

1. Field of the Invention

This invention relates to a latch device for a safety belt buckle in a vehicle.

2. Description of the Prior Art

Now that the importance of sefety belts in vehicles, especially, automobiles, has become recognized and the provision of such belts in vehicles is obligatory, it has become increasingly important to provide buckles which are structurally rigid and compact and which will ensure reliable engagement between the latch device and the tongue of the buckle. Some of the heretofore known buckles satisfy such requirements to a considerable degree but they require a great number of parts which means difficulties in assembling.

Further, many of the conventional buckles have play between the push button and the buckle base or the cover and such play often causes sounds of vibration to be undesirably produced during the running of the vehicles. This play also offers a disadvantage that the push button tends to become disengaged during the assembly, thus increasing the difficulties of assembly.

SUMMARY OF THE INVENTION

It is therefore an object of the present invention to provide a latch device for a safety belt buckle which is structurally sturdy and compact and which ensures reliable engagement between the latch device and the tongue and moreover can be assembled with ease.

It is another object of the present invention to provide a buckle for safety belt which eliminates any play between the cover or the base and the push button and which permits the cover and the push button to be united together during assembly so that the push button may never be disengaged from the cover even if it is vibrated or rotated.

According to the present invention, the latch device comprises a base, a latch member pivotally supported on the base and having a latching portion for locking a tongue, the latch member being biased to a tongue-locking position, a push button adapted, when operated, to bring the latch member to an unlocking position, and a cover having an inlet for inserting a tongue therethrough and an opening through which the push button may be operated, the latch member being pivotally supported in mutually opposed holes formed in the opposite side walls of the base.

The invention will become more fully apparent from the following detailed description thereof taken in conjunction with the accompanying drawings.

DESCRIPTION OF THE PREFERRED EMBODIMENT

A preferred embodiment of the present invention and a method of assembling the same will hereinafter be described in detail by reference to the drawings.

Figure 1:
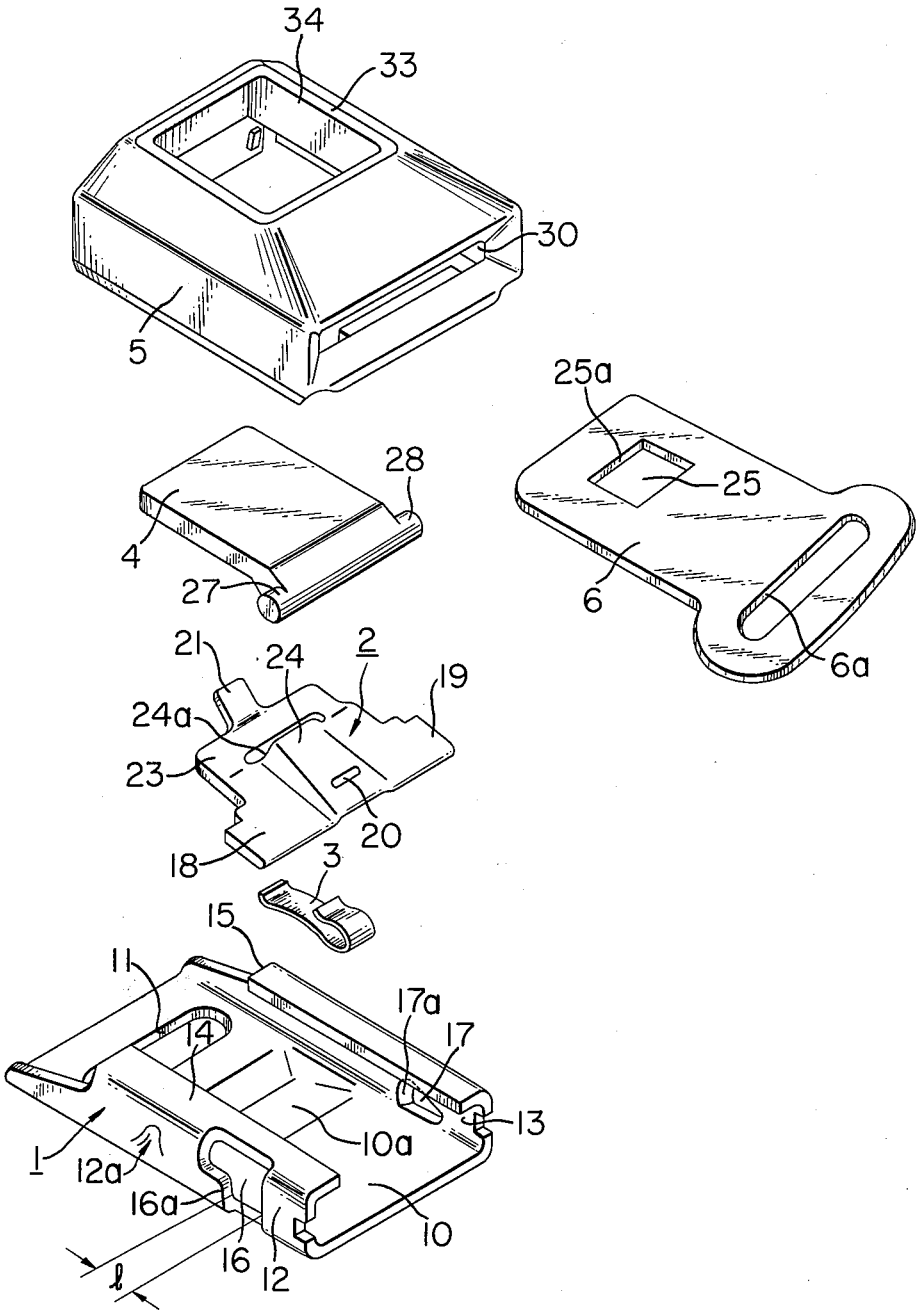
FIG. 1 is an exploded view of the buckle according to an embodiment of the present invention.

As shown in the exploded view of FIG. 1, a buckle comprises a latch device consisting of a base 1, a latch member 2, a spring 3 for biasing the latch member, a push button 4 and a cover 5, and a tongue 6 having a webbing mounting opening 6*a* and received into the latch device for engagement with the latch member 2. The base 1 has a central flat portion 10, and an opening 11 for securing therein a webbing, not shown, is formed in the flat portion 10 adjacent a lengthwise end thereof. The opposite sides of the base 1 form side walls 12 and 13 rising at about 90° with respect to the flat portion 10, and the upper ends of these side walls 12 and 13 both form inwardly bent portions 14 and 15. In the portion of the side wall 12 which is adjacent the opposite end from the opening 11, there is formed a hole 16 having its bottom provided by the flat portion 10. In the portion of the side wall 13 which is opposed to the hole 16 in the side wall 12, there is also formed a triangular hole 17 having its bottom provided by the flat portion 10 as is the hole 16. The lengthwise dimension 1 of each hole 16, 17 (the term "lengthwise" used herein refers to the direction in which the tongue is inserted) is sufficient to loosely receive positioning ears 18 and 19 formed in the opposite sides of the latch member 2, and the left edges 16*a* and 17*a* of the holes 16 and 17, as viewed in FIG. 1, rise substantially at right angles with the flat portion 10 and provide restraining surfaces for the ears 18 and 19 of the latch member 2, as will hereinafter be described.

Figure 2:
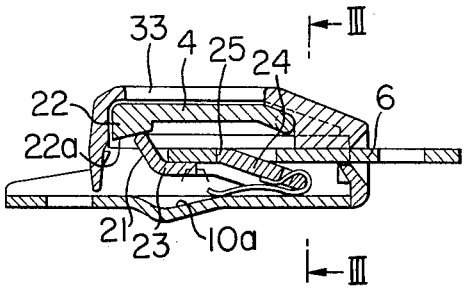
FIG. 2 is a lengthwise central cross-sectional view of the same buckle and showing a position in which the tongue is inserted.
Figure 3:
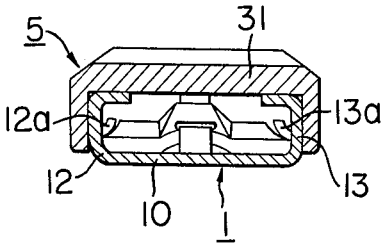
FIG. 3 is a cross-sectional view taken along line III—III in FIG. 2 and showing the buckle with the tongue removed.

The latch member 2 has a spring-hooking hole 20 formed adjacent the central lower end thereof, and the spring 3 is hooked therein. The latch member 2 is placed on the flat portion 10 with its ears 18 and 19 received in the holes 16 and 17 of the base 1 (FIGS. 5 and 8 to 10), and is normally upwardly biased by the spring 3. The central upper end portion of the latch member 2 is formed into an upwardly bent head 21 which, as will later be described, is in contact with a thick-walled end portion 22 of the push button 4 (FIG. 2). In the present embodiment, the central surface 22*a* of the thick-walled end portion 22 is formed as a sloped surface but may also be formed as a planar or a curved surface. In the position of FIG. 2, the shoulder 23 of the latch member 2 becomes substantially parallel to the flat portion 10 of the base 1 so that an appropriate clearance for receiving the tongue 6 may be provided between the shoulder 23 and the inwardly bent, upper end portions 14 and 15 of the side walls of the base. The latch member 2 is rotatable counterclockwise about the ears 18 and 19 against the biasing force of the spring 3 so that part or most of the shoulder 23 reaches a recess 10*a* provided in the flat portion 10 of the base. As the result, a sufficient clearance for receiving therein the tongue 6 is formed between the inwardly bent portions 14, 15 formed on the upper ends of the side walls 12, 13 and the latching portion 24, thus permitting insertion of the tongue. The tongue 6, when so inserted, is supported between the inwardly bent portions 14, 15 of the side walls 12, 13 and the inwardly directed projections 12*a*, 13*a* formed in the side walls 12, 13 (FIG. 3), and since the latching portion 24 of the latch 2 faces the opening of the tongue, the latch member 2 is returned to its original position by the action of the spring 3, whereby the restraining surface 25*a* of the opening 25 is restrained on the restraining surface 24*a* of the latching portion 24.

As shown in FIG. 1, the cover 5 is of an open-bottomed box shape and covers over the base 1 while being secured thereto. The font wall of the cover 5 is formed with a rectangular opening 30 for inserting the tongue therethrough, and the back wall of the cover 5 downwardly extends to such an extent that it substantially contacts the flat portion 10 of the base 1. The upper wall of the cover 5 has a thick-walled portion 31 somewhat protuberant from the vicinity of the upper ends of the side walls 12, 13 of the base 1 to the central rear portion thereof, and the top of the cover is formed with an opening 33 which faces the push button 4. A laterally facing support groove 29 is formed inwardly of the front of the thick-walled portion 31 and the push button is pivotally supported in the support groove 29 by means of pivot shafts 27, 28 formed on the opposite sides of the front end of the push button. The push button 4 has the thick-walled portion 22 formed centrally and inwardly of the other end thereof, and this thick-walled portion 22 is in contact with the head 21 (FIG. 2) of the latch member 2 as hereinabove described. Thus, the push button 4 is normally upwardly biased by the action of the spring 3 to assume the position of FIG. 2.

Figure 4:
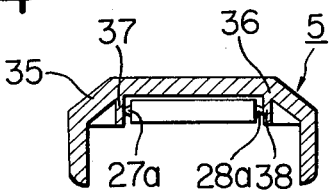
FIG. 4 shows a modified form of the means for assembling the push button to the cover.
Figure 5:
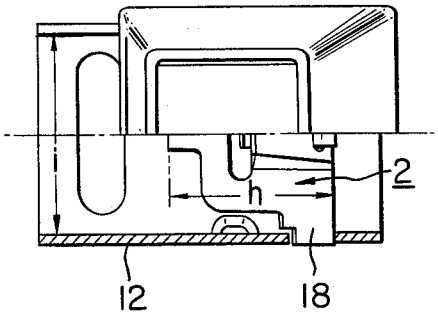
FIG. 5 is a plan view of the buckle showing a half thereof in cross-section.

FIG. 4 shows a modification of the means for assembling the push button 4 to the cover 5. The inside of the cover 5 forms a thick-walled portion 34 (FIG. 1) extending lengthwise along the opposite sides of the opening 33, and this thick-walled portion 34 becomes thin-walled outer wall portions 35, 36 in the vicinity of the points whereat it is continuous to the aforementioned front thick-walled portion 31. Inwardly of these thin-walled outer wall portions, there are provided substantially vertically extending, mutually opposed, thin-walled portions 37 and 38 which are integrally formed therewith. The push button 4 has shafts 27 and 28 formed on the opposite sides of the front end thereof and integrally therewith, and axially extending frusto-conical projections 27*a* and 28*a* (FIG. 4) are formed centrally of the end faces of these shafts 27 and 28. The distance between the outer end faces of the frusto-conical projections 27*a* and 28*a* is somewhat greater than the distance between the inner sides of the thin-walled portions 37 and 38, and the push button 4 is positioned with its frusto-conical projections 27*a* and 28*a* formed between the thin-walled portions 37 and 38. The push button 4 so positioned is pivotable about the points of engagement between the frusto-conical projections 27*a*, 28*a* and the thin-walled portions 37, 38.

Figure 6:
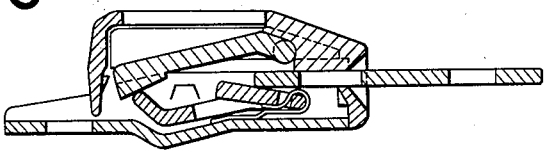
FIG. 6 is a lengthwise central cross-sectional view showing the position in which the tongue is removed.
Figure 7:
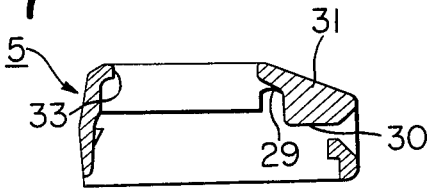
FIG. 7 is a lengthwise central cross-sectional view of the cover.

With the above-described construction, when the safety belt device is to be mounted, the tongue 6 may be inserted through the opening 30, whereby the fore end of the tongue 6 may contact the latching portion 24 of the latch member 2 to pivotally move the latch member 2 against the bias of the spring 3. The tongue may further be forced in until the restraining surface 24*a* of the latching portion 24 faces the opening 25 of the tongue 6, whereupon the latch member 2 is biased to its original position by the action of the spring 3, thus locking the tongue against withdrawal. Unlocking of the tongue 6 from the latch device may be accomplished by pushing the push button 4 to pivotally move the latch member 2 counter-clockwise against the bias of the spring 3, thus releasing the restraining action of the latching portion 24 to permit withdrawal of the tongue (FIG. 6).

Figure 8:
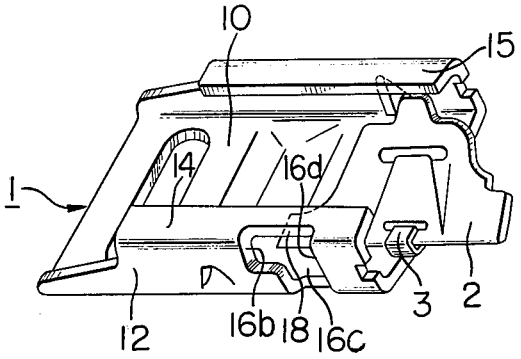
FIGS. 8 to 10 sequentially illustrate the method of assembling the latch member to the base.
Figure 9:
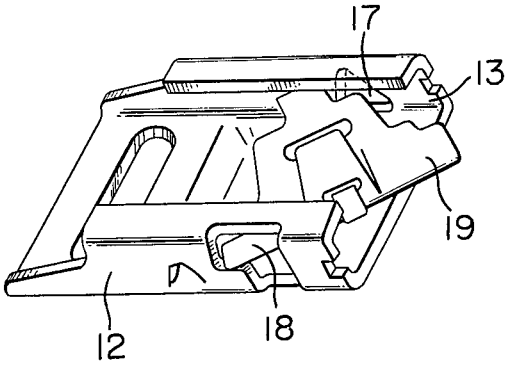
Figure 10:
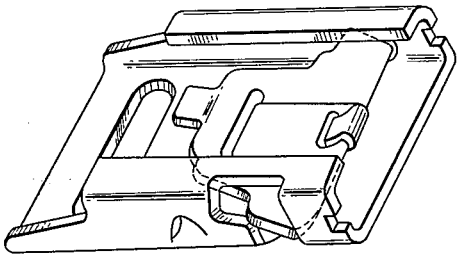

Reference will now be had to FIGS. 8 to 10 to describe the method of assembling the latch device according to the above-described embodiment. The upper half 16*b* of the hole 16 formed in the side wall 12 of the base 1 has a lengthwise dimension considerably greater than that of the lower half 16*c* of the hole 16. For example, in the present embodiment, the upper half 16*b* of the hole 16 provides an escape hole having a lengthwise width approximately twice that of the lower half 16*c*, and this upper half is formed by cutting into even a part of the upper or inwardly bent portion 14 of the side wall 12. On the other hand, the lengthwise dimension *h* of the latch member 2 is smaller than at least the distance *i* between the inner sides of the side walls 12 and 13 of the base (FIG. 5), and the latch member 2 has the spring 3 secured thereto beforehand. The latch member 2 with the spring 3 so secured thereto is held in a position which is 90° out of phase with the position in which it is mounted, namely, a position in which the aforementioned lengthwise direction of the latch member 2 is coincident with the lateral direction of the base 1 formed as shown in FIG. 1 (see FIG. 8), and then the latch member 2 is inserted from the right of the base 1 into between the flat portion 10 and the inwardly bent portions 14, 15 of the base 1, until the left end portion 18 of the latch member 2 passes to the upper half 16*b* of the hole 16 which provides the escape hole. When the distance from the right side edge 16*d* of the escape hole 16*b* to the right end of the latch member 2 has become less than the aforementioned distance *i* between the side walls 12 and 13, the latch member 2 is rotated counter-clockwise about the side edge 16*d*, as shown in FIG. 9. The latch member 2 is rotated through 90° until its ear 19 comes to oppose the triangular hole 17 of the base side wall 13, whereupon the latch member 2 is forced toward the side wall 13 to insert the ear 19 into the triangular hole 17 and to insert the other ear 18 into the lower half 16*c* of the hole 16. It is to be noted that the size of the escape hole 16*b* need not always be about twice the size of the lower half 16*c* if it permits the above-described rotation of the latch member. On the other hand, the push button 4 is inserted in place within the cover 5, and then the cover is assembled to the base 1 which is in the position of FIG. 10. In an internal portion of the cover which is opposed to the upper half 16*b* of the hole 16, there is formed a projection (not shown) for fitting in the upper hole half 16*b* during assembly of the cover to the base, thereby preventing the latch member 2 from floating up to provide unreliable locking. When the latch member is positioned with the aid of the base side walls as in the present invention, assembly can be simply accomplished as described, but alternatively it is of course possible to further increase the lengthwise dimension of the upper half 16*b* of the hole 16 so as to permit the latch member to be inserted into the base laterally thereof or from above it.

According to the present invention, the latch member is positioned with the aid of the side walls of the base and this enables the tongue to be locked more firmly. Thus, the present invention provides a latch device for buckle which is very simple and compact in construction and easy to operate.

Further, the present invention makes it very easy to assemble the latch device and permits the use of photodetector means or the like to automatically assemble the latch device.

Also, according to the present invention, the push button is mounted with its end being tightly fit to the internal thin-walled portions of the cover, thus preventing any sound of vibration which would otherwise tend to occur between the cover and the push button.

Furthermore, according to the present invention, the cover and the push button are brought into unitary relationship with each other during assembly and this facilitates the assembly of the buckle.

What I claim is:

1. In a safety belt buckle assembly including a tongue and a latch device for receiving and locking the tongue, the latch device comprising:

a base including a central portion having a downwardly projected recess portion, integral longitudinally extending walls on opposite sides of the central portion having opposed aligned openings, the side walls having integral inwardly directed upper end portions, the side walls having projections for positioning the tongue between the inwardly directed upper end portions and the projections;

a latch member having means at one end pivotally supported in said aligned openings, the latch member having at its opposite end a forward upwardly projecting portion for engagement by a push button, the latch member having an upwardly projecting latching portion substantially centrally thereof and between its ends for locking the tongue, and a flat shoulder portion between said forward upwardly projecting portion and said upwardly projecting latching portion for positioning the tongue thereupon and under said inwardly directed upper end portions;

biasing means disposed between said central portion of the base and said latch member so that the latch member is biased toward tongue-locking position;

a push button for actuating the latch member, the push button being formed at one end with a portion on its underside for engaging said forward upwardly projecting portion of the latch member so that the push button, when operated, will move the latch member to unlocking position where said flat shoulder portion is partially received in said recess portion of the base; and a cover having an inlet for inserting the tongue therethrough and an opening through which the push button may be operated, the cover being formed therewithin with a portion for pivotally supporting an end of the push button.

2. In a safety belt buckle assembly according to claim 1, wherein the opening in one side wall has an upper longer opening in communication therewith; wherein the lengthwise dimension of the latch member is smaller than the distance between said side walls; and wherein said longer opening is of sufficient length to permit the latch member to be inserted between the side walls approximately 90° out of phase with a predetermined set position thereof until one end of the latch member faces said longer opening, the latch member being rotatable about an edge of the opening to permit assembly in predetermined set position.

3. A latch device according to claim 2, wherein said cover has a pair of mutually opposed thin-walled portions formed therewithin, and the pivot of said push button is interference-fitted between said pair of thin-walled portions.

4. A latch device according to claim 3, wherein said pivot of said push button is provided with a pair of projections adapted to bear against said thin-walled portions of said cover in interference fit relationship therewith.

5. A latch device according to claim 4, wherein said projections provided on said pivot of said push button are of frusto-conical shape.

6. A latch device according to claim 1, wherein said cover has a pair of mutually opposed thin-walled portions formed therewithin, and the pivot of said push button is interference-fitted between said pair of thin-walled portions.

7. A latch device according to claim 6, wherein said pivot of said push button is provided with a pair of projections adapted to bear against said thin-walled portions of said cover in interference fit relationship therewith.

8. A latch device according to claim 7, wherein said projections provided on said pivot of said press button are of frusto-conical shape.

* * * * *